US007328835B2

(12) United States Patent
Menghini

(10) Patent No.: US 7,328,835 B2
(45) Date of Patent: Feb. 12, 2008

(54) MAILBOX DECORATION ACCESSORY STRUCTURE

(76) Inventor: Carol Menghini, 13205 Summerwood La., Alpharetta, GA (US) 30005

( * ) Notice: Subject to any disclaimer, the term of this patent is extended or adjusted under 35 U.S.C. 154(b) by 0 days.

(21) Appl. No.: 11/827,813

(22) Filed: Jul. 12, 2007

(65) Prior Publication Data

US 2007/0259197 A1 Nov. 8, 2007

(51) Int. Cl.
*A47G 29/12* (2006.01)

(52) U.S. Cl. ..... 232/38; 40/606.06; 40/566

(58) Field of Classification Search ..... 232/38, 232/17; 40/606.06, 566; D99/29–32, 43; 150/154; 52/3

See application file for complete search history.

(56) References Cited

U.S. PATENT DOCUMENTS 1,495,741 A 5/1924 Higdon, Jr.
4,991,769 A * 2/1991 Todd ..... 232/17
5,984,172 A * 11/1999 Easterwood ..... 232/38
6,296,180 B1 10/2001 Blizzard
6,308,884 B1 * 10/2001 Hamburger ..... 232/38
6,619,541 B2 * 9/2003 Martin et al. ..... 232/38
6,726,089 B1 * 4/2004 Jones ..... 232/38
6,962,284 B1 * 11/2005 Hartelius et al. ..... 232/38
2002/0092901 A1 * 7/2002 Paschal ..... 232/38
2003/0057267 A1 * 3/2003 Martin et al. ..... 232/38

* cited by examiner

*Primary Examiner*—William L. Miller
(74) *Attorney, Agent, or Firm*—Myers & Kaplan, LLC; George P. Bonanto; Barry E. Kaplan

(57) ABSTRACT

A mailbox accessory structure used to decorate a freestanding mailbox is disclosed. The structure includes left and right surfaces with substantially connected front and back sides that substantially enclose the mailbox. The surfaces permit the display of indicia, such as holiday images, logos, slogans, and initials, and allow the mailbox to be decorated with a selected shape, such as a shape appropriate for a holiday or event.

17 Claims, 6 Drawing Sheets

MAILBOX DECORATION ACCESSORY STRUCTURE

RELATED APPLICATIONS

The present U.S. Utility Non-provisional Patent Application is related to, and hereby claims priority to, and the benefit of, U.S. Non-provisional Utility Patent Application entitled "Decorative Mailbox Accessory Structure," having assigned Ser. No. 11/096,867, filed on Apr. 1, 2005 now U.S. Pat. No. 7,261,233 on behalf of Carol Menghini, which is related to, and claimed priority to, and the benefit of, U.S. Provisional Utility Patent Application entitled "Mailbox Stocking," having assigned Ser. No. 60/558,980, filed on Apr. 2, 2004 on behalf of Carol Menghini.

TECHNICAL FIELD

The present invention relates generally to mailbox accessories, and more particularly, to a mailbox accessory for decorating a mailbox.

BACKGROUND OF THE INVENTION

Mailboxes are the common mechanism used by homeowners to receive mail. Generally they consist of the mailbox itself attached to a mailbox post. Together they are produced in many standard shapes and sizes that conform to postal office regulations. Mailboxes usually stand at the forefront of a home, accessible to the deliverer of mail but also visible to the passersby. Mailboxes are thus a prominent extension of the personality of the home and homeowner and present a decorative opportunity to the homeowner.

Some patents have been issued in the art of mailbox decoration:

U.S. Pat. No. 5,984,172, entitled "Freestanding Mailbox Cover", issued to Rodney T. Easterwood on Nov. 16, 1999, discloses an ornamental and protective cover for a freestanding mailbox which includes a sheet presenting a pair of opposed sides, a front panel presenting a passage for mail to be inserted into the mailbox, and a rear panel, the front and rear panels being connected to and interconnecting the sides. The sides and front and rear panels preferably extend downwardly a common length to their respective bottom margins to enclose a region therein. The cover may be provided with decorative and informative indicia. Moreover, the cover, which is preferably of flexible synthetic resin material, may be opaque, transparent or translucent, with cut out openings and windows of transparent material provided over the openings. A light fixture or audio source may be provided within the enclosed region. The cover may be retained in position over the freestanding mailbox by weights attached adjacent the bottom margin or the use of a drawstring to pull the bottom margin of the sides of the cover together.

U.S. Pat. No. 5,000,379, entitled "Mail Box Cover", issued to Benjamin R. LaRue on Mar. 19, 1991, discloses a rectangular paper or plastic film sheet that has a pressure sensitive backing for sticking onto the curved top and sides of a regulation mailbox. The front face is imprinted with decorative graphics arranged to be seen from both sides. Below each graphic is imprinted an elongate address bar for receiving stick-on letters numbers supplied in a color contrasting with the address bar for enhanced visibility. Partially cut through portions of the cover may be torn away to admit the indicating flag. The system is adapted for application without tools or special skills and enough letters and numbers are provided for identification of the mailbox as recommended by postal authorities.

U.S. Pat. No. 4,813,595, entitled "Mailbox for Receiving Decorative Overlays", issued to Benjamin I. Johns, et al., on Mar. 21, 1989, discloses a mailbox which comprises a housing having flanges located at the bottom, outside periphery thereof and defining holding grooves for peripheral edges of a decorative overlay. Sides of the housing have holes therein which align with corresponding holes of the decorative overlay when the peripheral edges are inserted into the grooves. The decorative overlay is attached to the mailbox by inserting removable fasteners into the aligned holes, thus allowing the overlay to be readily attached to and removed from the housing.

U.S. Pat. No. 6,296,180, entitled "Postal Box Covering", issued to Clarence E. Blizzard on Oct. 2, 2001, discloses a postal box covering for protecting a postal box from the elements of weather. The postal box covering includes a plurality of elongate members. Each of the elongate members has a longitudinal axis. Each of the elongate members has a first side, a second side, a third side, a fourth side, a first end and a second end. The elongate members are generally oriented parallel to each other. The elongate members are between a first and a second elongate member. A plurality of straps bind the elongate members together. Each of the straps is adjacent to each of the second sides of the elongate members. A plurality of fastening devices fasten the straps to the elongate members. A plurality of mountings are fixedly coupled to the first and second elongate members. A plurality of brackets have a base portion and two arm members extending therefrom. The arm members are oriented generally parallel to each other and are spaced. One of the arm members is releasably coupled to each of the mountings.

U.S. Pat. No. 6,308,884, entitled "Device and Method for Suspending a Flag Display from a Mailbox", issued to Robert Hamburger, on Oct. 30, 2001, discloses a system and method of attaching a flag display to a mailbox in a manner that enables the flag display to hang below the mailbox. The system includes a flag display that has a length equivalent to the sum of the combined lengths of the two sides of the mailbox and the front of the mailbox. The top edge of the flag display attaches to the exterior of the mailbox, near its base. The flag display attaches to the mailbox using hook-and-loop material or some other equivalent fastening means. The flag display hangs down from the base of the mailbox while maintaining the generally rectangular configuration of the mailbox base. At the bottom of the flag display, the flag display is either weighted or anchored to the mailbox post.

U.S. Pat. No. 1,495,741, entitled "Advertising Mail-box Support", issued to Elijah L. Higdon, Jr., on May 27, 1924, discloses an advertising frame support for rural mail boxes which can be cheaply constructed; which will afford a firm and satisfactory mounting for the mail box; and which comprises a frame work preferably formed of light structural iron and containing an advertising panel adapted to form a brace for the light frame which is disposed at right angles to the road to display both sides of the panel to the road.

While these patents teach the concept of covers with decoration for mailboxes, they do not teach a housing mechanism for placing decorative objects within the cover structure so that decorative objects are visibly displayed.

Thus there remains a need for an invention that decorates a mailbox while providing a housing mechanism for visibly displaying decorative objects. The invention should be inexpensive and easy for the mailbox owner to assemble. The present invention addresses these needs by enclosing the mailbox with a structure having an opening in which to place decorative objects.

BRIEF SUMMARY OF THE INVENTION

Briefly described, in a preferred embodiment, the present invention overcomes the above-mentioned disadvantages and meets the recognized need for such a device by providing a decorative mailbox accessory structure comprising a top portion, a left side portion depending from the top portion, a right side portion depending from the top portion, a front portion connecting the left side portion to the right side portion, and a back portion, wherein the top portion comprises a cutout proximate the back portion for receiving a mailbox support member therethrough. The fabric body may be formed by joining a plurality of panels or by selectively folding a blank, and joining adjacent portions thereof or adding removable attachment means for removably attaching adjacent portions of the blank.

According to its major aspects and broadly stated, the present invention in its preferred form is a fabric body for attaching to, and at least partially enclosing, a mailbox.

According to one aspect of the preferred embodiment, a mailbox opening is included to provide access to a mailbox to which the decorative mailbox accessory structure is attached.

According to another aspect of the preferred embodiment, an operable flap is provided to enlarge the mailbox opening or otherwise provide access to an additional receptacle of the mailbox, such as a newspaper receptacle.

According to another aspect of the preferred embodiment, an operable closure is provided for selectively encircling a supporting post of the mailbox for at least partial concealment of the supporting post and for secure attachment of the decorative mailbox accessory structure thereto.

According to another aspect of the preferred embodiment, a releasably sealable flag opening is provided to allow selective operation of a flag of the mailbox.

According to another aspect of the preferred embodiment, a releasably sealable sign opening is provided to allow a sign of the mailbox, such as a street number sign, to protrude therethrough.

According to another aspect of the preferred embodiment, releasably attachable flaps are provided to selectively form a horizontal beam opening separate from the cutout for allowing a horizontal beam of the mailbox post to extend therethrough.

According to another aspect of the preferred embodiment, one or more indicia is provided on an exterior surface of the decorative mailbox accessory structure.

According to another aspect of the preferred embodiment, an inflation means is provided to inflate the body of the decorative mailbox accessory structure.

According to another aspect of the preferred embodiment, one or more of a light generating means, a sound generation means, a wire framework, and a grounding means is provided.

The present invention further overcomes the above-mentioned disadvantages and meets the recognized need for such a device by providing a method of manufacturing a decorative mailbox accessory structure comprising the steps of obtaining a sheet blank, folding the sheet blank to form a left side portion, a right side portion, and a top portion therebetween, folding at least one of the right side portion and the left side portion to form a front portion, attaching the front portion to at least one of the right side portion and the left side portion to secure the front portion, folding at least one of the left side portion and the right side portion to form a back portion, and attaching the back portion to at least one of the right side portion and the left side portion to encircle a support structure of a mailbox.

Accordingly, a feature and advantage of the present invention is its ability to at least partially cover a mailbox and a support member thereof with a decorative mailbox accessory structure.

These and other features and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which.

Figure 1:
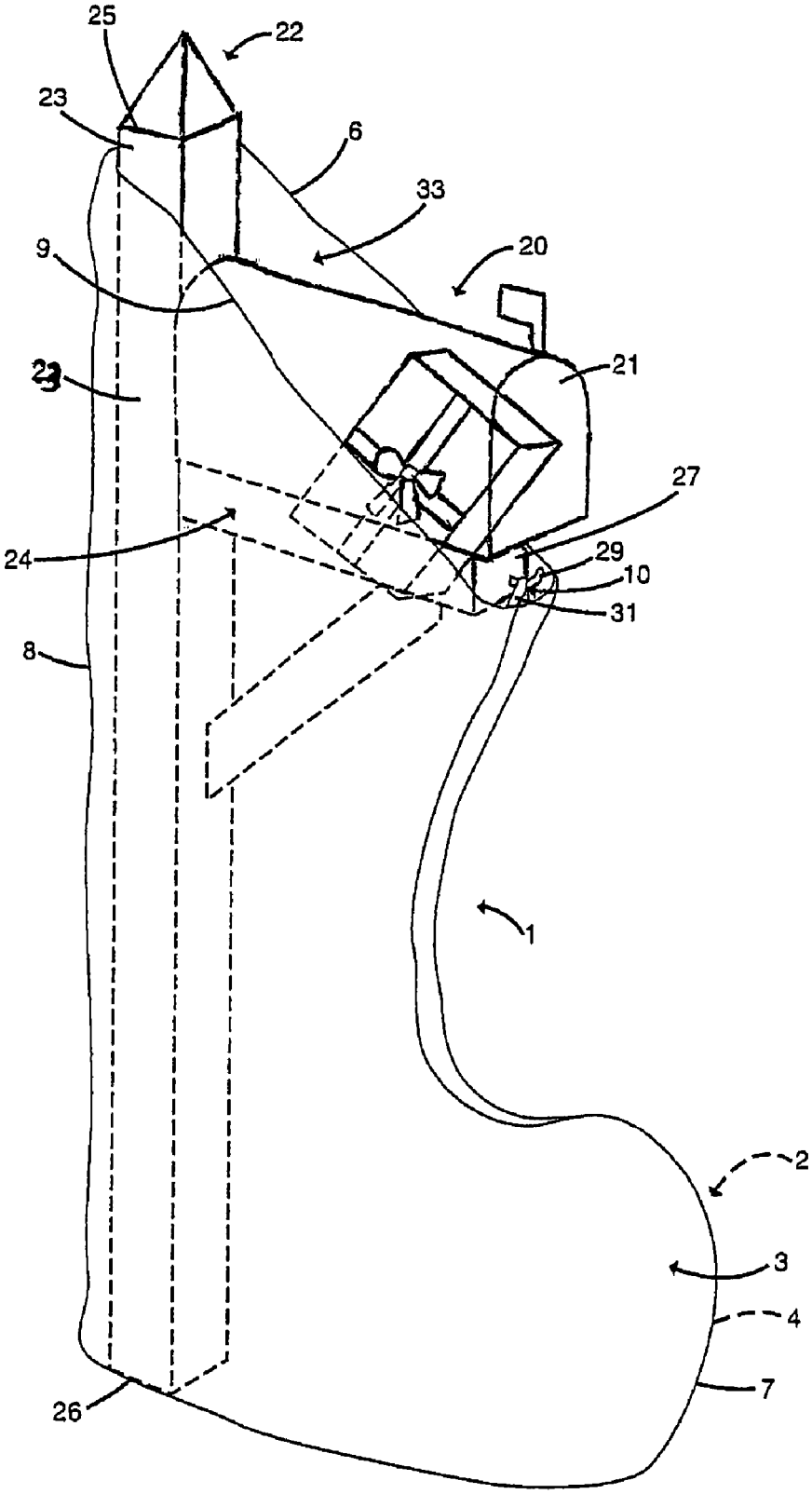
FIG. 1 is a front perspective view of a decorative mailbox accessory structure connected to a mailbox according to the present invention.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

In that form of the preferred embodiment of the present invention chosen for purposes of illustration, FIGS. 1-4*e* show mailbox accessory structure 1, designed to be used in combination with mailbox 20, which preferably includes box 21 and supporting post 22. Supporting post 22 is preferably formed by vertical beam 23 and horizontal beam 24, with horizontal beam 24 preferably intersecting vertical beam 23. Vertical beam 23 preferably has top end 25 and bottom end 26. Horizontal beam 24 preferably has front end 27 and back end 28. Box 21 preferably rests upon horizontal beam 24.

Figure 2:
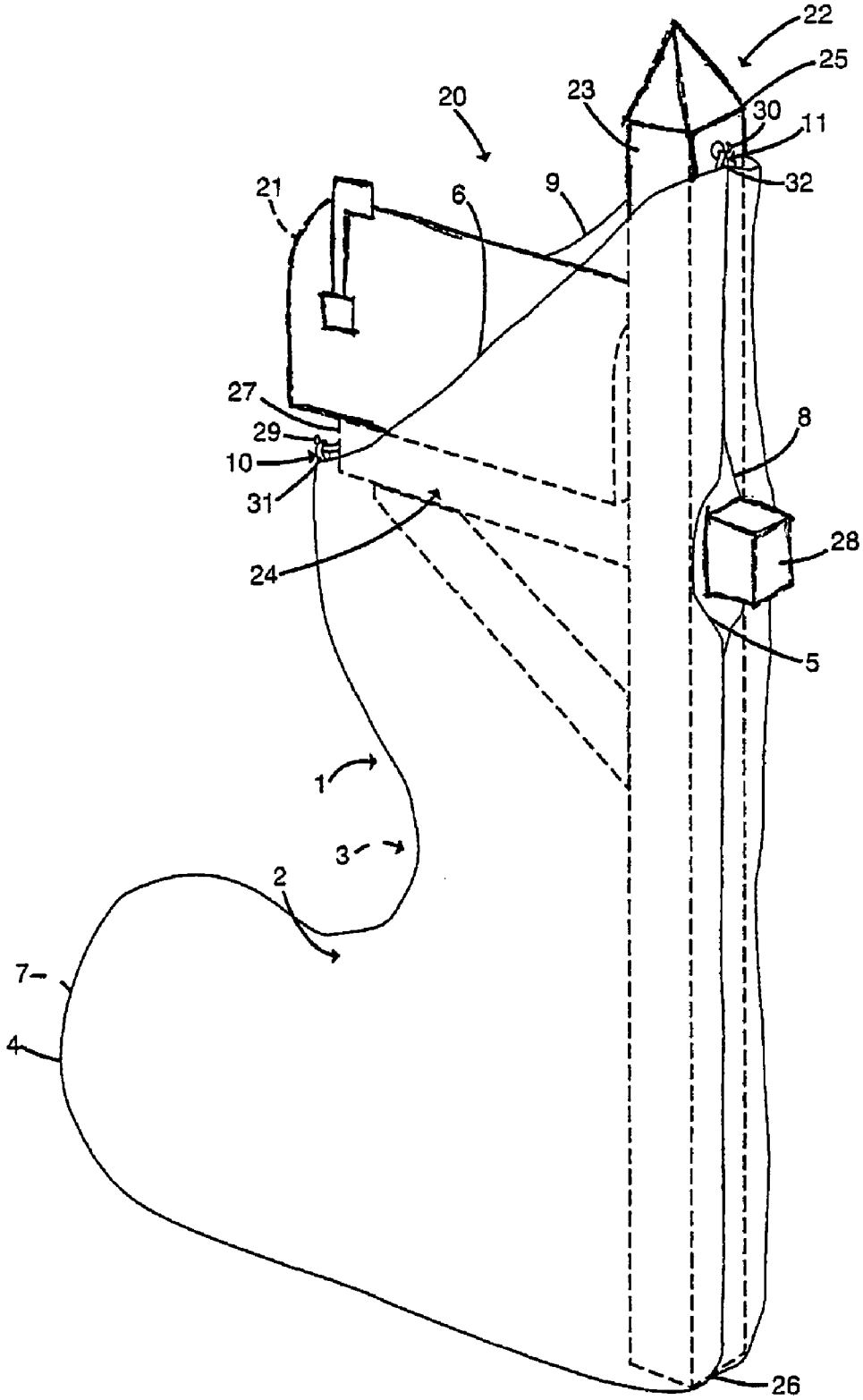
FIG. 2 is a back perspective view of the decorative mailbox accessory structure of FIG. 1.
Figures 3A, 3B:
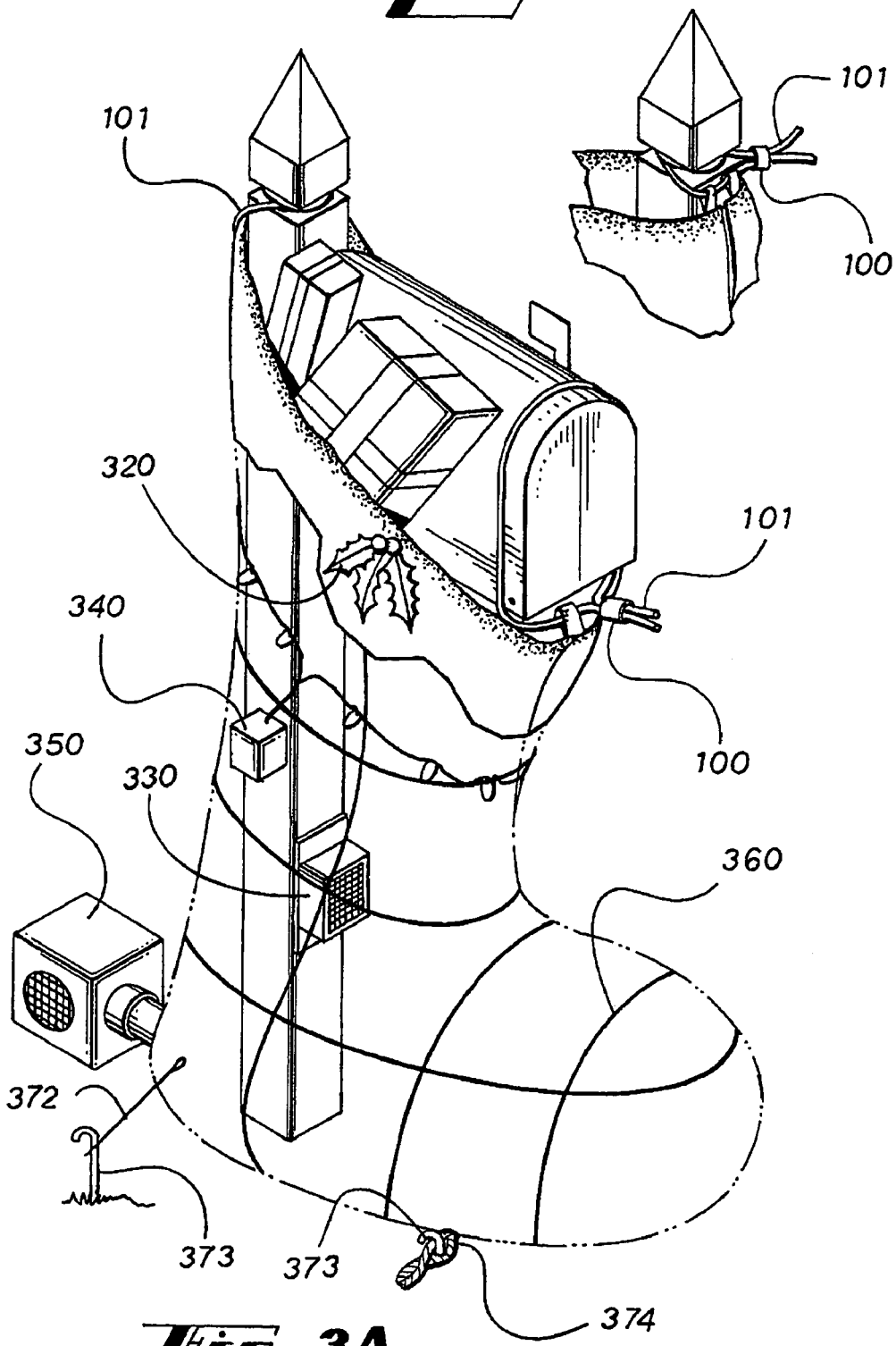
FIG. 3A is a partial cut-away front perspective view of the decorative mailbox accessory structure of the present invention.
FIG. 3B is a back perspective detail view of a connecting device of the present invention.
Figure 4A:
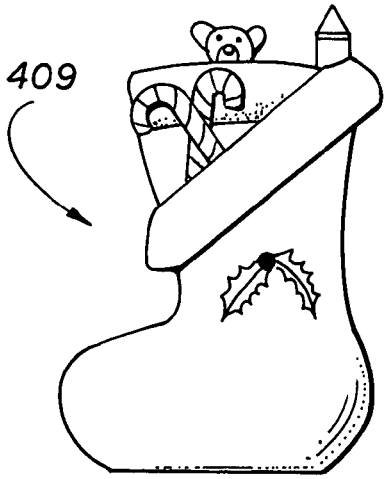
FIGS. 4*a-e* are side plan views of decorative mailbox accessory structures according to alternative designs.
Figure 4B:
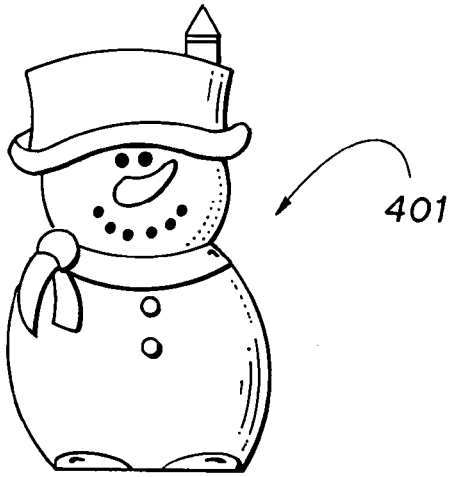
Figure 4C:
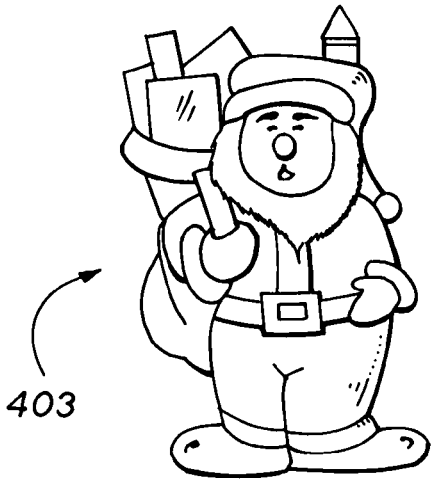
Figure 4D:
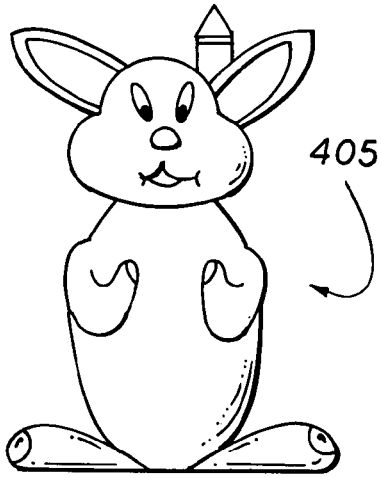
Figure 4E:
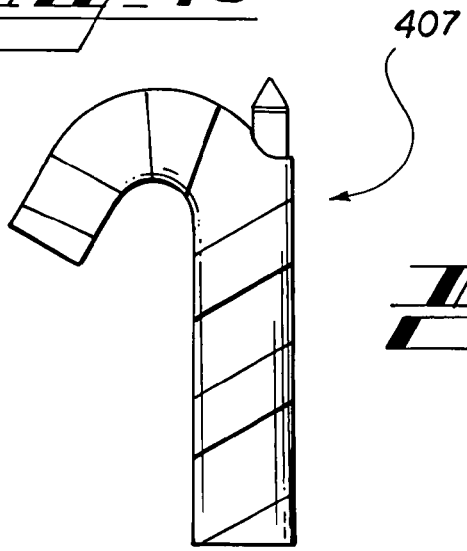

According to one embodiment, of the present invention, decorative mailbox accessory structure 1 preferably provides a structure comprised of at least two opposed surfaces: left surface 2 and right surface 3. As depicted in FIGS. 1 and 2, left surface 2 is preferably located to a left side of mailbox 20 and right surface 3 is preferably located to a right side of mailbox 20. Left surface 2 and right surface 3 both preferably have substantially three sides. Left surface 2 is preferably formed by left surface front side 4, left surface back side 5, and left surface top side 6. Likewise, right surface 3 is preferably formed by right surface front side 7, right surface back side 8, and right surface top side 9. Left surface front side 4 and right surface front side 7 preferably form a shape of a holiday stocking. In other embodiments, left surface front side 4 and right surface front side 7 may be joined together to form other shapes, such as a snowman shape 401, a Santa Claus shape 403, an Easter Bunny shape 405, candy cane shape 407, stocking shape 409, or the like.

The heights of left surface front side 4, and right surface front side 7, are preferably about a height measured from the ground to a location proximate box 21. Left surface top side 6 and right surface top side 9 are preferably between about twenty-four and about thirty-six inches in length. Left surface back side 5 and right surface back side 8 are preferably about the height of vertical post 23. Decorative mailbox accessory structure 1, will preferably substantially enclose mailbox 20, leaving opening 33, allowing for the placement and retention of objects therein. Box 21 preferably remains visible to passersby and accessible to mailpersons when decorative mailbox accessory structure is connected thereto. Preferably, left surface 2 and right surface 3 are made of a durable, flexible, or stretchable material, such as woven fabric, canvas, nylon, plastic, polyester, vinyl, or the like. The material is preferably weather resistant and/or opaque or translucent.

Left surface 2 and right surface 3 are preferably connected to each other. For example, left surface front side 4 may be connected to right surface front side 7, such as by any commonly used mechanism to connect two surfaces of the type of material used for left surface 2 and right surface 3. For example, if left surface 2 and right surface 3 are cloth, they may be sewn together. Alternatively, left surface front side 4 may be unitary with right surface front side 7, i.e. they may be seamlessly connected or formed from a single piece of material. Left surface back side 5 is preferably releasably connected to right surface back side 8. The releasable connection is preferably effected by using any one of a variety of commonly used attachment devices, such as VELCRO, buttons, laces, strings, rope, and zippers.

With continued reference to FIGS. 1-4*e*, front end connecting device 10 preferably releasably connects decorative mailbox accessory structure 1 to front end 27 of horizontal beam 24. Back side connecting device 11 preferably releasably connects decorative mailbox accessory structure 1 near top end 25 of vertical beam 23. Front end connecting device 10 and back end connecting device 11 preferably include commonly used attachments mechanisms, such as tab and hook devices. For example, in FIGS. 1 and 2, first hook 29 is preferably disposed at front end 27 of the horizontal beam 24. Second hook 30 is preferably disposed near top end 25 of vertical beam 23. First tab 31 is preferably connected to decorative mailbox accessory structure 1, and preferably loops over first hook 29. Second tab 32 is preferably connected to decorative mailbox accessory structure 1, and preferably loops over second hook 30. In another preferred embodiment, shown in FIGS. 3A and 3B, cord 101 and lock 100 device is preferably used to join decorative mailbox accessory structure 1 to mailbox 20 by looping cord 101 through first tab 31 and circling it around box 21. Cord 101 and lock 100 device is preferably used to connect decorative mailbox accessory structure to supporting post 22 by looping cord 101 through second tab 32, and then circling cord 101 around top end 25 of vertical beam 23.

In one preferred embodiment, the invention preferably carries and displays indicia 320. Indicia 320 may be messages, such as, but not limited to, familiar holiday symbols, logos, initials, and the like. Indicia 320 may be stitched to, painted on, printed onto, or cut out from, left surface 2 and/or right surface 3.

Decorative mailbox accessory structure 1 is preferably connected to the ground through ground connecting means. The ground connecting means is preferably formed as a selected one of many common means for connecting aboveground structures to the ground. Such means preferably include stakes 373, guy-wires or cords 372, tabs 371 (FIGS. 5 and 6), ropes 374, or the like. Preferably, decorative mailbox accessory structure 1 is staked to the ground via guy wire or cable 372. Alternatively, however, decorative mailbox accessory structure 1 may be connected to stake 373 via rope 374 or fabric tab 371.

Decorative mailbox accessory structure 1 is preferably further given shape by an inflatable mechanism 350, such as a fan or pump that may increase the ambient fluid pressure within decorative mailbox accessory structure 1, or as a balloon, a bladder, or other device or material disposed within decorative mailbox accessory structure 1 to ensure inflation thereof. Alternatively or additionally, however, decorative mailbox accessory structure 1 may be given shape by wire framework 360. Wire framework 360 is preferably placed inside decorative mailbox accessory structure 1, and preferably generally internally supports and shapes the structure. Furthermore, wire framework 360 may optionally be used as a connection means for left surface back side 5 and right surface back side 8 by including a male connector on a first portion and a female connector on a second portion.

Light creation mechanism 340 may additionally be placed inside decorative mailbox accessory structure 1. Light creation mechanism 340, when placed within decorative mailbox accessory structure 1, preferably adds to the decorative visual appeal of decorative mailbox accessory structure 1, especially in darkness. Light creation mechanism 340 is preferably a light bulb, or string of light bulbs, but may alternatively be an LED, fluorescent, phosphorescent, solar, fiber optic, or other suitable lighting means.

Audio mechanism 330 is further preferably placed inside decorative mailbox accessory structure 1 such that sounds, such as holiday music, may emanate from inside decorative mailbox accessory structure 1. Audio mechanism 330 is preferably a music player, such as a tape player, a CD player, an MP3 player, or other suitable sound creation means.

Decorative mailbox accessory structure 1 is preferably assembled by placing first hook 29 at front end 27 of horizontal beam 24, placing second hook 30 near top end 25 of vertical beam 23, connecting first tab 31 to the mailbox supporting post 22, by looping it over first hook 29, joining left surface back side 5 and right surface back side 8 by an attachment mechanism, and connecting second tab 32 to the mailbox supporting post 22 by looping it over second hook 30.

Decorative mailbox accessory structure 1 is preferably formed according to the following:

EXAMPLE

Decorative mailbox accessory structure 1 is preferably provided having two surfaces, each having substantially three sides, to form a stocking-like structure. The structure is made of fabric, such as faux fur. The back sides of the two surfaces connect using VELCRO. The front sides of the two surfaces are sewn together. The structure is joined to the front and back ends of a mailbox using a hook and tab system. Once connected, the structure partially encloses the mailbox, yet permits the mailbox to be opened and closed. The structure also allows for decorative objects to be placed and retained between the structure and the mailbox, thus giving the appearance that the decorative object is stored within a stocking.

Figures 5, 6:
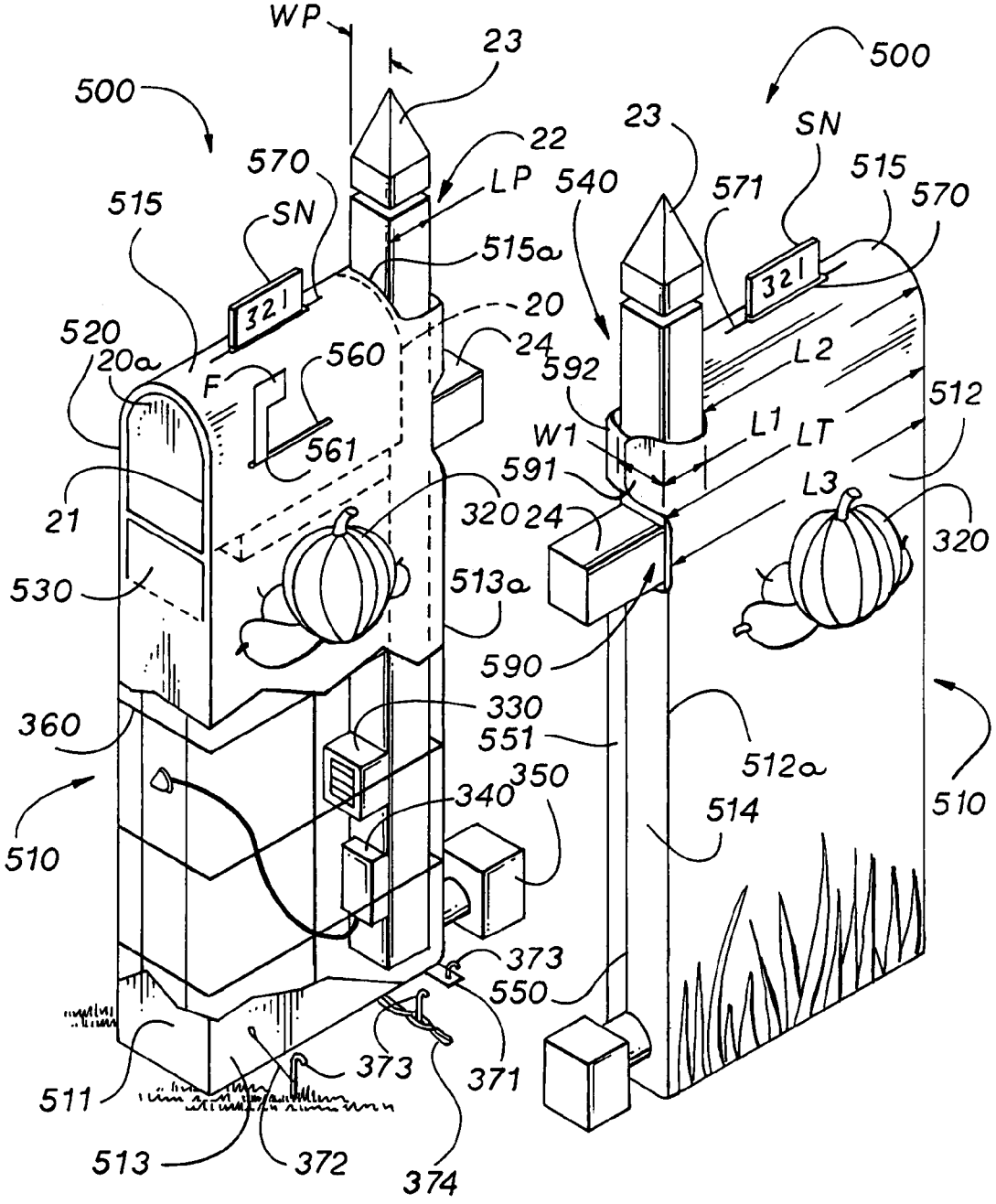
FIG. 5 is a front perspective view of a decorative mailbox accessory structure according to a preferred embodiment of the present invention.
FIG. 6 is a rear perspective view of the decorative mailbox accessory structure of FIG. 5.
Figure 7:
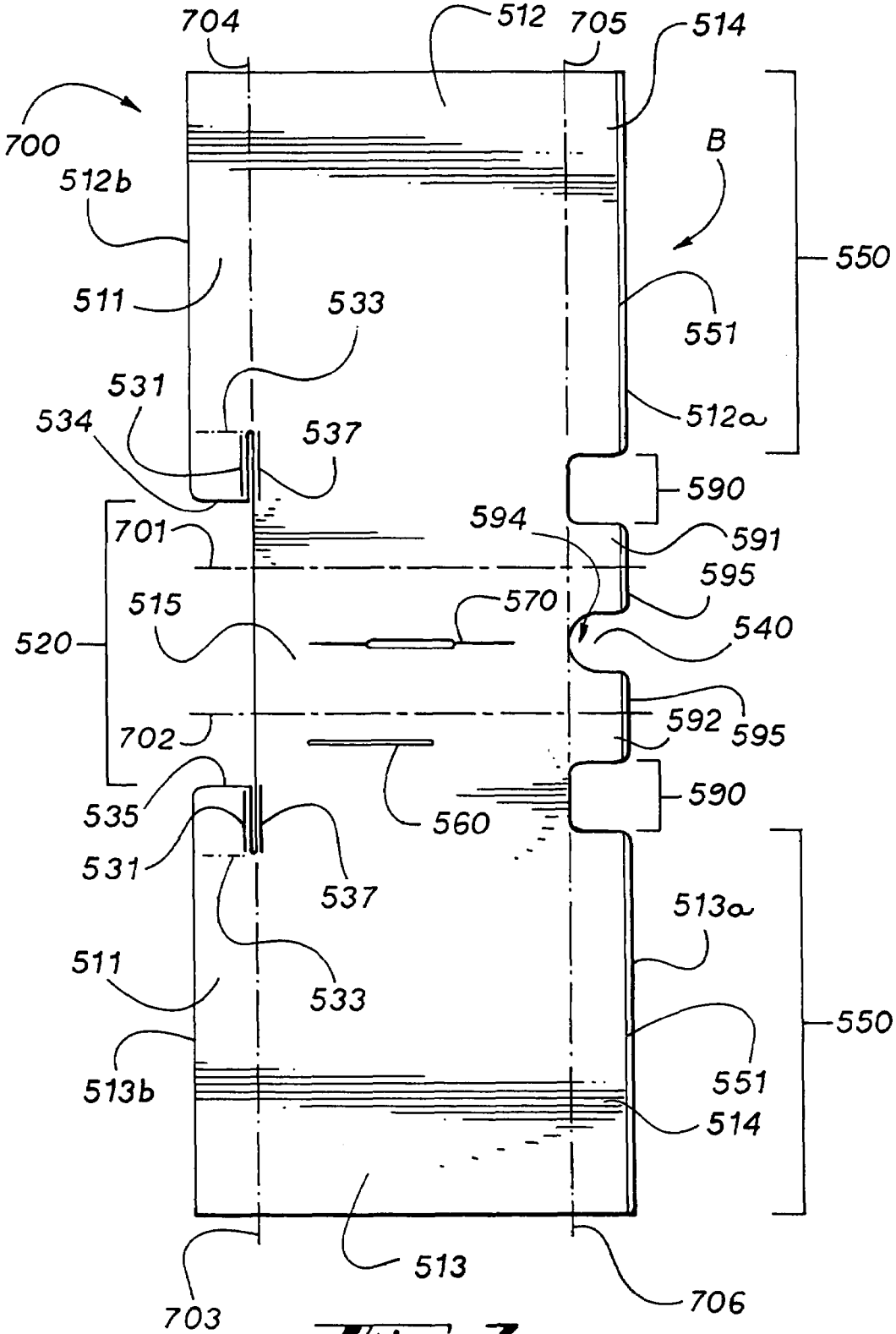
FIG. 7 is a plan view of a blank used to form a decorative mailbox accessory structure according to the present invention.

Now referring to FIGS. 5-7, decorative mailbox accessory structure 500, according to an alternative embodiment, preferably comprises fabric body 510, including front portion 511, left side portion 512, right side portion 513, back portion 514, and top portion 515. Decorative mailbox accessory structure 500 preferably further includes opening 520 for allowing access to mailbox 20, operable flap 530 for allowing selective access to a receptacle below the mailbox, post opening 540 for allowing horizontal beam 24 and/or vertical beam 23 to pass therethrough, and operable closure 550, including attachment means 551, for enclosing supporting post 22. Decorative mailbox accessory structure 500 may, optionally, further include indicia 320, audio mechanism 330, light creation mechanism 340, inflatable mechanism 350, wire framework 360, tabs 371, guy wires 372, stakes 373, and/or ropes 374, as described above with respect to decorative mailbox accessory structure 1.

Decorative mailbox accessory structure 500 preferably further includes flag opening 560 for allowing operation of flag F of mailbox 20 and street number sign opening 570 for allowing a street number sign, or other sign, to pass therethrough. Each of flag opening 560 and sign opening 570 preferably includes attachment means 561, 571, respectively, for attaching adjacent portions thereof, thereby sealing flag opening 560 and/or sign opening 570. Preferably, attachment means 571 further allow a dimension of sign opening 570 to be adjusted to snugly accommodate signs of various dimensions. Attachment means 551, 561, and 571 are preferably formed as hook-and-loop fasteners, but may, alternatively, be formed as snaps, buttons, zippers, ties, clips, magnets, toggles, or other suitable releasable attachment means.

Decorative mailbox accessory structure 500 is preferably installed over mailbox 20 such that front 20*a* of mailbox 20 preferably is accessible through mailbox opening 520, such that at least a portion of supporting post 22 preferably protrudes through post opening 540, and such that fabric body 510 is preferably disposed over mailbox 20 and around supporting post 22. Decorative mailbox accessory structure 500 is preferably closed around supporting post 22 via operable closure 550. When decorative mailbox accessory structure 500 is so installed on mailbox 20, operable flap 530 is preferably aligned with a receptacle disposed below box 21, if one is included in mailbox 20, such that selective operation of operable flap 530 selectively allows access to such receptacle. Furthermore, when decorative mailbox accessory structure 500 is so installed on mailbox 20, street numbers SN preferably protrude through street number sign opening 570, and flag F may be raised and lowered through flag opening 560.

Post opening 540 is preferably formed within top portion 515 such that post opening 540 has length L1 in a direction from front portion 511 to back portion 514 and width W1 in the direction of from left side portion 512 to right side portion 513. Preferably, length L1 of post opening 540 is approximately equal to, and not less than length LP of vertical beam 23, and width W1 of post opening is preferably approximately equal to, and not less than, width WP of vertical beam 23. Thus, post opening 540 is preferably adapted to allow vertical post 23 to pass therethrough. As such, post opening 540 may optionally be formed from back edge 515*a* of top portion 515, such that post opening 540 defines a U-shaped cutout in top portion 515, or may be formed as an aperture through top portion 515 such that back edge 515*a* encircles vertical beam 23 passing through post opening 540.

In order to conceal at least a portion of vertical beam 23 from a side, each of left side portion 512 and right side portion 513 preferably have length L3 from front portion 511 to back portion 514, at least over at a portion thereof, that is at least as great as combined length LT equal to length L2 of top portion 515 proximate post opening 540 and length L1 of post opening 540. Thus, back edge 512*a* of left side portion 512 and back edge 513*a* of right side portion 513 are preferably disposed further from front portion 511 than a portion of back edge 515*a* of top portion 515.

As such, fabric body 510 is preferably formed by blank 700, such as by cutting out from a sheet of material. Blank B may preferably be folded along lines 701 and 702 to form left side portion 512, right side portion 513, and top portion 515 therebetween. Left side portion 512 may preferably be folded along line 704 to form at least a portion of front 511 and right side portion 513 may preferably be folded along line 703 to form the rest of front 511. Front edge 512*b* of left side portion 512 may preferably be attached to front side edge 513*b* of right side portion 513 to form mailbox opening 520 and to enclose mailbox 20 and supporting post 22 from the front. Front side edges 512*b* and 513*b* are preferably attached via stitching, although other attachment techniques and/or means may be used, such as heat sealing, welding, adhering, riveting, hook-and-loop fasteners, clips, snaps, buttons, zippers, toggles, and the like.

Left side portion 512 may preferably be folded along line 705 to form at least a portion of back 514, and right side portion 513 may preferably be folded along line 706 to form the rest of back 514. Attachment means 551 may preferably be attached to back edges 512*a* and 513*a*, at least at portions thereof, to form operable closure 550 for releasably enclosing at least a portion of vertical post 23. Attachment means 551 preferably comprise a hook-and-loop fastener, but may alternatively comprise magnets, buttons, zippers, toggles, clips, snaps, ties, or the like. Preferably, attachment means 551 extends over substantially all of back edges 512*a* and 513*a*, and may additionally allow for selective formation of horizontal beam opening 590 between flaps 591 and 592 of left side portion 512 and right side portion 513, respectively, when flaps 591 and 592 are selectively attached to one another around supporting post 22, at a location above horizontal beam 24. Such attachment of flaps 591 and 592 is preferably accomplished by attachment means 595, such as a hook-and-loop fastener, buttons, magnets, zippers, snaps, rivets, ties, or the like.

Operable flap 530 is preferably formed by slits 531 formed in blank B, such that when front edges 512*b* and

513*b* are joined, as described above, operable flap 530 is defined by edges 534 and 535 across the top thereof, slits 531 along respective sides thereof, and folds 533 along the bottom thereof. Thus, when front edges 512*b* and 513*b* are attached to one another, operable flap 530 may be selectively operated to extend mailbox opening 520 over a portion of front portion 511 by selectively releasing attachment means 537 disposed along slits 531.

Blank B is preferably formed such that flaps 591 and 592 are separated by U-shaped cutout 594, forming at least a portion of post opening 540. When flaps 591 and 592 are not connected to one another around supporting post 22, the post opening 540 is preferably U-shaped. When flap 591 is connected to flap 592, however, post opening 540 becomes a closed loop aperture. Thus, flaps 591 and 592 allow selective configuration of decorative mailbox accessory structure 500 to alter the configuration of post opening 540 such that decorative mailbox accessory structure 500 is selectively configurable to attach to a selected one of a plurality of different styles of mail receptacles and/or supporting posts.

Although decorative mailbox accessory structure 500 has been described as being formed of blank B by folding, it will be understood that alternative construction techniques may be employed to form decorative mailbox accessory structure 500 having a front, a left side, a right side, a back and a top, and including mailbox opening 520, operable flap 530, post opening 540, operable closure 550, flag opening 560, sign opening 570, and/or horizontal beam opening 590. Such alternative construction techniques may involve joining a plurality of panels by one or more attachment means and techniques, such as stitching, adhesive, welding, zippers, hook-and-loop fasteners, snaps, buttons, clips, toggles, ties, rivets, or the like.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is:

1. A decorative mailbox accessory structure for a mailbox and its associated support structure, the mailbox having a flag and a sign disposed thereon, said decorative mailbox accessory structure comprising:

a top portion;

a left side portion depending from said top portion;

a right side portion depending from said top portion;

a front portion connecting said left side portion to said right side portion;

a back portion, wherein said top portion comprises a cutout proximate said back portion for receiving the support structure therethrough; and cooperating flaps defining said cutout and having releasable attachment means for selectively connecting around the support structure.

2. The decorative mailbox accessory structure of claim 1, further comprising a mailbox opening in said front portion.

3. The decorative mailbox accessory structure of claim 1, further comprising a flag opening disposed proximate the flag of the mailbox.

4. The decorative mailbox accessory structure of claim 3, further comprising releasable attachment means disposed proximate said flag opening for selectively closing said flag opening.

5. The decorative mailbox accessory structure of claim 1, further comprising an operable flap disposed proximate Said front portion for selectively accessing a receptacle below the mailbox.

6. The decorative mailbox accessory structure of claim 5, further comprising releasable attachment means disposed proximate said operable flap for selectively closing said operable flap.

7. The decorative mailbox accessory structure of claim 1, further comprising a sign opening disposed proximate the sign of the mailbox.

8. The decorative mailbox accessory structure of claim 7, further comprising releasable attachment means disposed proximate said sign opening for selectively closing said sign opening.

9. The decorative mailbox accessory structure of claim 1, wherein said decorative mailbox accessory structure takes a form selected from the group consisting of a stocking, a snowman, a Santa Claus, an Easter Bunny, and a candy cane.

10. The decorative mailbox accessory structure of claim 1, further comprising at least one support means selected from the group consisting of inflation means and a wire framework.

11. The decorative mailbox accessory structure of claim 1, further comprising at least one decoration means selected from the group consisting of light generation means, sound generation means, and indicia.

12. The decorative mailbox accessory structure of claim 1, further comprising at least one grounding means selected from the group consisting of a cable, a rope, a tab, a wire, and a stake.

13. The decorative mailbox accessory structure of claim 1, further comprising releasable attachment means disposed proximate said back portion for releasably connecting said left side portion to said right side portion via said back portion.

14. A method of manufacturing a decorative mailbox accessory structure for a mailbox and its associated support structure comprising the steps of:

obtaining a blank formed from a sheet of material;

folding said blank to form a left side portion, a right side portion, and a top portion therebetween;

folding at least one of said right side portion and said left side portion proximate a front thereof to form a front portion;

attaching at least one of said right side portion and said left side portion proximate the front thereof to secure said front portion;

folding at least one of said left side portion and said right side portion proximate a back thereof to form a back portion; and releasably attaching at least one of said right side portion and said left side portion proximate the back thereof to secure said back portion, whereby said decorative mailbox accessory encircles the support structure of the mailbox.

15. The method of claim 14, wherein said blank comprises a cutout proximate a central portion of a peripheral edge thereof, wherein said step of folding the blank forms said top to include said cutout, and wherein said step of folding at least one of said left side portion and said right side portion to form said back portion forms said back portion proximate said cutout.

16. The method of claim 14, wherein said blank further comprises at least one slit formed therein.

17. The method of claim 14, wherein said blank further comprises at least one attachment means disposed proximate at least one of said back portion, said front portion, and said top portion.

* * * * *